US007824506B2

(12) United States Patent
Machida et al.

(10) Patent No.: US 7,824,506 B2
(45) Date of Patent: Nov. 2, 2010

(54) ND-FE-B MAGNET WITH MODIFIED GRAIN BOUNDARY AND PROCESS FOR PRODUCING THE SAME

(75) Inventors: Kenichi Machida, Osaka (JP); Shunji Suzuki, Osaka (JP)

(73) Assignees: Japan Science and Technology Agency, Kawaguchi-shi (JP); Osaka University, Suita-shi (JP)

( * ) Notice: Subject to any disclaimer, the term of this patent is extended or adjusted under 35 U.S.C. 154(b) by 444 days.

(21) Appl. No.: 11/793,272

(22) PCT Filed: Dec. 14, 2005

(86) PCT No.: PCT/JP2005/022963

§ 371 (c)(1),
(2), (4) Date: Jun. 15, 2007

(87) PCT Pub. No.: WO2006/064848

PCT Pub. Date: Jun. 22, 2006

(65) Prior Publication Data

US 2008/0006345 A1 Jan. 10, 2008

(30) Foreign Application Priority Data

Dec. 16, 2004 (JP) ..... 2004-365088

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

2002/0062884 A1 * 5/2002 Kaneko et al. ..... 148/301

(Continued)

FOREIGN PATENT DOCUMENTS

JP 60-54406 A 3/1985

(Continued)

OTHER PUBLICATIONS

K. T. Park et al.; "Effect of Metal-Coating and Consecutive Heat Treatment on Coercivity of Thin Nd-Fe-B Sintered Magnets"; Proc. 16th Workshop on Rare-Earth Magnets and Their Aplication, Sendai, p. 257-264 (2000).

(Continued)

*Primary Examiner*—John P Sheehan
(74) *Attorney, Agent, or Firm*—Westerman, Hattori, Daniels & Adrian, LLP

(57) ABSTRACT

In known methods, an improvement of the coercive force is realized by allowing the Dy metal or the like to present selectively in crystal grain boundary portions of a sintered magnet. However, since these are based on a physical film formation method, e.g., sputtering, through the use of a vacuum vessel, there is a mass productivity problem when a large number of magnets are treated. Furthermore, there is a magnet cost problem from the viewpoint that, for example, an expensive, high-purity Dy metal or the like must be used as a raw material for film formation. The method for modifying grain boundaries of a Nd—Fe—B base magnet includes the step of allowing an M metal component to diffuse and penetrate from a surface of a Nd—Fe—B base sintered magnet body having a Nd-rich crystal grain boundary phase surrounding principal $Nd_2Fe_{14}B$ crystals to the grain boundary phase through a reduction treatment of a fluoride, an oxide, or a chloride of an M metal element (where M is Pr, Dy, Tb, or Ho).

6 Claims, 4 Drawing Sheets

U.S. PATENT DOCUMENTS

| | | | | |
|---|---|---|---|---|
| 2007/0034299 | A1 * | 2/2007 | Machida et al. | 148/105 |
| 2008/0245442 | A1 | 10/2008 | Nakamura et al. | |

FOREIGN PATENT DOCUMENTS

| | | | |
|---|---|---|---|
| JP | 61-207546 | A | 9/1986 |
| JP | 62-074048 | A | 4/1987 |
| JP | 63-219548 | A | 9/1988 |
| JP | 1-117303 | A | 5/1989 |
| JP | 5-21218 | A | 1/1993 |
| JP | 2002-105503 | A | 4/2002 |
| JP | 2004-296973 | A | 10/2004 |

OTHER PUBLICATIONS

International Search Report of PCT/JP2005/022963, date of mailing Feb. 28, 2006.

M. Homma et al.; Binary alloy method for the production of ND-Fe-Co-B permanent magnets Diamond and Related Materials, Advanced Materials vol. 14B, (1993), pp. 1013-1016.

Japanese Office Action dated Jan. 26, 2010, issued in corresponding Japanese Application No. 2006/548887.

Machida et al., "Grain boundary modification and magnetic properties of Nd-Fe-B sintered magnet", Abstract of Spring Meeting of Japan Society of Powder and Powder Metallurgy, 2004, p. 202.

Nakamura, "Ultra-micro shaped Nd-Fe-B sintered magnet", IEEJ Journal, 2004, pp. 699-702, vol. 124, No. 11.

* cited by examiner

ND-FE-B MAGNET WITH MODIFIED GRAIN BOUNDARY AND PROCESS FOR PRODUCING THE SAME

TECHNICAL FIELD

The present invention relates to a high-performance magnet including grain boundaries modified by diffusion and penetration of a Dy element, a Tb element, or the like from a magnet surface to a crystal grain boundary phase of a Nd—Fe—B base magnet and exhibiting excellent mass productivity, as well as a method for manufacturing the same.

BACKGROUND ART

Rare—earth element—iron—boron base magnets are widely used for voice coil motors (VCM) of hard disk drives, magnetic circuits of magnetic resonance imaging (MRI), and the like. In recent years, the applicability has been expanded to driving motors of electric cars. In particular, the heat resistance is required in the automobile use, and a magnet having a high coercive force is required to avoid high-temperature demagnetization at an environmental temperature of 150° C. to 200° C.

A Nd—Fe—B base sintered magnet has a microstructure in which principal $Nd_2Fe_{14}B$ compound phases are surrounded by a Nd-rich grain boundary phase, and component compositions, sizes and the like of these principal phase and grain boundary phase play important roles in exerting a coercive force of a magnet. In general sintered magnets, high coercive forces are exerted by containing about a few percent by mass to ten percent by mass of Dy or Tb in magnet alloys and taking the advantage of the magnetic properties of a $Dy_2Fe_{14}B$ compound or a $Tb_2Fe_{14}B$ compound having an anisotropic magnetic field larger than that of the $Nd_2Fe_{14}B$ compound. However, there is a problem in that the saturation magnetization is decreased sharply and, thereby, the maximum energy product ($(BH)_{max}$) and the remanent magnetic flux density (Br) are reduced as the content of Dy or Tb is increased. Furthermore, since Dy and Tb are rare resources and are expensive metals costing a few times as much as Nd does, the usage thereof must be reduced.

In order to improve the coercive force of the Nd—Fe—B base sintered magnet while a decrease in the remanent magnetic flux density is suppressed, it is desirable to magnetically strengthen crystal grain boundaries and a magnet surface layer, which tend to become generation sources of reverse magnetic domains, by cleaning. It is known that the presence of Dy, Tb, and the like in the grain boundary phase on a priority basis rather than in the principal $Nd_2Fe_{14}B$ phase is effective.

For example, in known methods, an alloy primarily containing $Nd_2Fe_{14}B$ and an alloy containing a high proportion of Dy and the like are prepared separately, each powder is mixed at an appropriate ratio, and molding and sintering are conducted so as to improve the coercive force in the production of a sintered magnet (Patent Documents 1 and 2 and Non-Patent Document 1).

There are methods in which any scheme during a production process of a sintered magnet is not used, but a treatment of the resulting sintered material is conducted. In the reported methods, a rare-earth metal is introduced into the surface and a grain boundary phase of a minute and fine Nd—Fe—B base sintered magnet molded material so as to recover the magnetic properties (Patent Documents 3 and 4), or a Dy or Tb metal is applied by sputtering to a surface of a magnet processed into a small size, and a high-temperature heat treatment is conducted so as to diffuse Dy or Tb into the inside of the magnet (Non-Patent Documents 2 and 3). In addition, there is a method in which Dy is diffused into grain boundaries of a Nd—Fe—B base sintered magnet. A method in which a sputtered film is heated (Patent Document 5) and a method in which a fine powder of an oxide or a fluoride of Dy is applied to a magnet and, thereafter, a surface diffusion treatment and an aging treatment are conducted (Non-Patent Document 4) have been reported.

[Patent Document 1] Japanese Unexamined Patent Application Publication No. 61-207546

[Patent Document 2] Japanese Unexamined Patent Application Publication No. 05-021218

[Patent Document 3] Japanese Unexamined Patent Application Publication No. 62-74048

[Patent Document 4] Japanese Unexamined Patent Application Publication No. 2004-296973

[Patent Document 5] Japanese Unexamined Patent Application Publication No. 01-117303

[Non-Patent Document 1] M. Kusunoki et al. 3rd IUMRS Int. Conf. On Advanced Materials, p. 1013 (1993)

[Non-Patent Document 2] K. T. Park et al. Proc. 16th Workshop on Rare Earth Magnets and Their Application, Sendai, p. 257 (2000)

[Non-Patent Document 3] Machida et al. Japan Society of Powder and Powder Metallurgy Heisei 16 Nendo Shunki Taikai Kouen Gaiyoshu (Summary of Fiscal 2004 Spring Meeting), p. 202 (2004)

[Non-Patent Document 4] H. Nakamura, IEEJ Journal, Vol. 124, No. 11, pp. 699-702 (2004)

DISCLOSURE OF THE INVENTION

Problems to be Solved by the Invention

In the above-described Patent Documents 1 and 2, examples of the sintered magnet are shown, wherein two alloys were used as starting materials, the distribution of the Dy element or the like in the Nd-rich grain boundary phase surrounding the principal $Nd_2Fe_{14}B$ phases was made larger than that in the $Nd_2Fe_{14}B$ phase, and as a result, the coercive force was able to be improved while a decrease in the remanent magnetic flux density was suppressed. However, there are many problems from the viewpoint of the production in that, for example, additional man-hours are required for preparing alloys containing a large proportion of Dy and the like, the oxidation must be further prevented since the alloys containing a large proportion of Dy and the like tend to be oxidized significantly as compared with an alloy having a composition of $Nd_2Fe_{14}B$, and sintering and heat treatment reactions of the two alloys must be precisely controlled. Furthermore, the magnet produced by this method has a low remanent magnetic flux density since about a few percent by mass to 10 percent by mass of Dy is still contained in the magnet and the major portion thereof is contained in the principal $Nd_2Fe_{14}B$ phase.

The inventors of the present invention previously found that after a predetermined amount of film of Dy or Tb metal was formed on a magnet surface by sputtering or the like, a heat treatment was conducted, the Dy or Tb metal was allowed to diffuse and penetrate into the inside of the magnet through the grain boundary phase selectively and, thereby, the coercive force was able to be improved effectively, and filed patent applications for the inventions related to this method (Japanese Patent Application No. 2003-174003; Japanese Unexamined Patent Application Publication No. 2005-

11973, and Japanese Patent Application No. 2003-411880; Japanese Unexamined Patent Application Publication No. 2005-175138).

In these methods, an improvement of the coercive force is realized by allowing the Dy metal or the like to present selectively in a crystal grain boundary portion of a sintered magnet. However, since these are based on a physical film formation method, e.g., sputtering, through the use of a vacuum vessel, there is a mass productivity problem in the case where large amounts of magnet is treated. Furthermore, there is a magnet cost problem from the viewpoint that, for example, an expensive, high-purity Dy metal or the like must be used as a raw material for film formation.

Means for Solving the Problems

The Inventors of the present invention have succeeded in developing a manufacturing method suitable for mass production, based on the findings of the above-described inventions. In the method, no expensive Dy or Tb metal is used as a raw material for film formation, more inexpensive compounds, e.g., oxides and fluorides thereof, which are easy-to-get resources, are used, and a grain boundary modification treatment of large amounts of magnet products can be conducted at a time without using a complicated vacuum vessel.

In the Nd—Fe—B base sintered magnet, a high coercive force can be achieved by allowing Dy, Tb, or the like to present at a high concentration in a crystal grain boundary phase surrounding principal $Nd_2Fe_{14}B$ phases, that is, by grain boundary modification. In each of the specifications of Japanese Patent Application No. 2003-174003 and Japanese Patent Application No. 2003-411880, the inventors of the present invention have disclosed the inventions related to the principle and the technique of increasing a coercive force efficiently without decreasing the remanent magnetic flux density. This principle is applied in the present invention as well. A metal component, e.g., Dy or Tb, having a magnetic anisotropy larger than that of Nd, is deposited by reduction on a Nd—Fe—B base magnet surface from a compound thereof and, at the same time, the metal component is allowed to diffuse and penetrate into crystal grain boundaries in the inside from the magnet surface.

In this method, the component, e.g., Dy or Tb, may remain as a film on the magnet surface after the diffusion and penetration. However, in contrast to a known method in which a corrosion-resistant film, e.g., Ni or Al coating, is formed for the purpose of improving or enhancing the magnetic properties of the magnet, it is important to allow the component, e.g., Dy or Tb, to diffuse and penetrate into crystal grain boundaries in the inside from the magnet surface.

The mechanism of the improvement of magnetic properties by this diffusion penetration treatment will be described below. The inside of a general Nd—Fe—B base sintered magnet has a structure in which a grain boundary phase (the thickness is about 10 to 100 nm, and the phase is primarily composed of Nd, Fe, and 0 and is referred to as a Nd-rich phase) surrounds around principal $Nd_2Fe_{14}B$ crystals having a size of about 3 to 10 μm. When about 5 percent by mass, for example, of Dy is added to a raw material alloy and sintering is conducted as a most general method for increasing the coercive force of this magnet, Dy is distributed uniformly in both the principal crystals and the grain boundary phase and, thereby, the coercive force is increased, whereas Dy substitutes for about 20 percent by mass of Nd in the principal $Nd_2Fe_{14}B$ crystals so as to cause significant decrease in the remanent magnetization. Therefore, a magnet having a high energy product cannot be produced under present circumstances.

It has been ascertained that in the method of the present invention, an M element, e.g., Dy, deposited by reduction on a magnet surface through chemical reduction or molten-salt electroreduction of a metal compound hardly substitutes for Nd in the principal $Nd_2Fe_{14}B$ crystals in the processes of diffusing and penetrating into the inside of the magnet during reduction treatment and a structure in which the crystal grain boundary phase is enriched selectively is formed, that is, the grain boundaries are modified. The principle of this method, which takes advantage of the chemical reduction or the molten-salt electroreduction, is that an oxide, e.g., $Dy_2O_3$, is donated with an electron by a reaction with a Ca component or electrolysis and Dy is generated through reduction. Therefore, reduction reaction with the Nd—Fe—B component constituting the magnet hardly occurs, so that the magnet is not damaged.

On the other hand, the Dy component is also allowed to diffuse and penetrate into the magnet by covering the Nd—Fe—B magnet with a $Dy_2O_3$ powder alone and conducting a heat treatment at a high temperature of about 800° C. to 1,000° C. However, since no reducing agent is used in this case, $Dy_2O_3$ reacts gradually with the Nd component on a Nd—Fe—B magnet surface at a high temperature and, thereby, reduction occurs by bonding of Dy to Nd. Consequently, there is a problem in that soft magnetic α-Fe phase, $DyFe_2$ phase, and the like are produced as by-products, wherein a part of the magnet surface layer becomes in a state of Nd defect and the coercive force is deteriorated. This is not preferable as the manufacturing method.

The depth of diffusion of the M element varies depending on the heating temperature and the time of the reduction treatment, and is about 20 micrometers to 1,000 micrometers from the surface. It was ascertained that the configuration of the grain boundary phase after the diffusion and the penetration was an M-Nd—Fe—O system from the analytical result of EPMA(Electron Probe Micro-Analyzer). The thickness of the grain boundary phase is estimated to be about 10 to 200 nanometers.

As described above, a larger proportion of the M element is present in a surface portion of the magnet as compared with the inside and the M element hardly substitutes for Nd in the principal $Nd_2Fe_{14}B$ crystal. This is an evidence indicating that occurrence of a reverse magnetic domain is suppressed by a structure in which the grain boundary phase is enriched with the M element selectively as compared with the inside of the principal crystal, and the coercive force of the original Nd—Fe—B base magnet is improved.

In the present invention, it can be easily realized in a single treatment step that a compound, e.g., an oxide or a fluoride, of Dy, Tb, or the like is heated at a high temperature by using a Ca reducing agent or electrolysis so as to be reduced to a metal, e.g., Dy or Tb, and at the same time, the metal component is allowed to diffuse and penetrate selectively into the grain boundary phase in the inside of the magnet. The melting point of the Nd-rich grain boundary phase is low as compared with the melting point (1,000° C. or more) of the $Nd_2Fe_{14}B$ phase and, therefore, selective diffusion tends to occur.

ADVANTAGES

According to the present invention, inexpensive compounds of Dy, Tb, and the like are used as raw materials, metals, e.g., Dy and Tb, are deposited by reduction on a surface of the rare-earth magnet and are allowed to diffuse and penetrate into the inside of the magnet, so that a significant increase in the coercive force can be achieved and demagnetization at high temperatures can be significantly improved. Consequently, the present invention can contribute significantly to production of rare-earth magnets suitable for car driving motors and the like required to have heat resistance. Furthermore, the coercive force compatible to that of a known sintered magnet can be exerted even when the content of Dy, Tb, or the like is small. Therefore, the present invention contributes to dissolution of a rare resource problem.

BEST MODE FOR CARRYING OUT THE INVENTION

A Nd—Fe—B base magnet of the present invention and a method for manufacturing the same will be described below in further detail. A target magnet of the present invention is a sintered magnet. The Nd—Fe—B base sintered magnet has a crystal texture in which a Nd-rich crystal grain boundary phase surrounds principal $Nd_2Fe_{14}B$ crystals, and exhibits a typical nucleation-type coercive force mechanism, so that the effect of increasing the coercive force is large in the present invention.

The sintered magnet is formed by grinding a raw material alloy into the size of a few micrometers, followed by molding and sintering. In the Nd—Fe—B base sintered magnet, a grain boundary phase is formed when the amount of Nd becomes larger than that in the $Nd_2Fe_{14}B$ composition (=27.5 percent by mass of Nd). Furthermore, a practical Nd composition is 29 to 30 percent by mass of Nd in consideration of oxidation and the like in the process of sintering. In a general sintered magnet, Pr, Y, and the like are contained as impurities or to reduce the cost. Therefore, the magnetic property improving effect of the present invention is exerted even when the total amount of rare-earth elements is about 28 to 35 percent by mass. If the amount exceeds 35 percent, the proportion of the grain boundary phase becomes excessive, and the coercive force is adequately increased, whereas the proportion of the principal $Nd_2Fe_{14}B$ phases responsible for the magnetic flux density is relatively decreased, and a practical remanent magnetic flux density and a practical maximum energy product cannot be attained.

The method of the present invention can be applied to every magnet having a crystal texture in which a grain boundary phase surrounds principal $Nd_2Fe_{14}B$ phase crystals, and there is no harm in containing not only the components constituting Nd—Fe—B, but also other additional components, for example, Co for improving temperature properties and Al, Cu, and the like for forming a fine, uniform crystal texture. Furthermore, the method of the present invention is not influenced essentially by the magnetic properties of an original magnet and the amounts of addition of rare-earth elements other than Nd. Therefore, the coercive force of a high-performance sintered magnet containing about 0.2 percent by mass or more and 10 percent by mass or less of M element in the principal phase and the grain boundary phase in total can also be effectively improved by adding beforehand the M element to the raw material for sintering and conducting sintering.

A rare-earth element selected from Pr, Dy, Tb, and Ho (hereafter appropriately referred to as an "M" element) is used alone or in combination as the element to be supplied to the magnet surface and allowed to diffuse and penetrate into the inside of the magnet, since the element is used for the purpose of having a magnetic anisotropy larger than that of Nd constituting the Nd—Fe—B base magnet and easily diffusing and penetrating into the Nd-rich phase and the like surrounding the principal phases in the inside of the magnet. In particular, the anisotropic magnetic fields of a $Dy_2Fe_{14}B$ compound and a $Tb_2Fe_{14}B$ compound are two times and three times, respectively, that of $Nd_2Fe_{14}B$. Therefore, the Dy element and the Tb element exert a large effect of increasing the coercive force.

In order to stably supply the above-described element to the magnet surface, a method for refining a rare-earth metal can be applied in principle. In the refining method, a rare-earth metal oxide, a rare-earth metal chloride, or a rare-earth metal fluoride separated from a raw ore and refined is reduced by molten-salt electrolysis or a chemical reducing agent. A Ca metal, a Mg metal, or a hydride thereof is suitable for the chemical reducing agent. If this chemical reduction or molten-salt electroreduction is not used, a part of the Nd—Fe—B magnet surface may be altered and the magnetism may be deteriorated, as described above. Therefore, it is not preferable.

The present invention is characterized in that reduction of the M metal compound to the M metal and diffusion of the M metal into the inside of the magnet are conducted basically in the same step. An aging treatment at 500° C. to 600° C. may be additionally conducted or other aging treatment by using a furnace may be additionally conducted following this step without conducting further treatment, and thereby, the coercive force can be further improved.

In the present invention, an expensive M metal is not used, and at least one of oxides, fluorides, and chlorides of the M metals produced in the refining process of various rare-earth metals can be used. Among them, the oxides and the fluorides are stable. Therefore, they can be handled easily in the air, and are converted to compounds, CaO and $CaF_2$, respectively, by Ca reduction. These can easily be separated from the surface of the magnet body. On the other hand, in the case where reduction reaction is not conducted under an appropriate condition, the chlorides may react with the magnet to generate a chlorine gas, so that caution must be taken. However, the chlorides can be used in the present invention basically.

There are various methods for reducing M metal compounds to produce M metals. However, it is preferable to adopt any one of the following three types of representative method.

<First Method> Solid Phase Reduction Method

A Nd—Fe—B base magnet body processed into a desired shape is embedded in a mixed powder of, for example, $Dy_2O_3$ as an example of various compounds of the M element and $CaH_2$ serving as a chemical reducing agent, followed by pressing lightly, if necessary, and is put in a heat-resistant vessel, e.g., a crucible made of graphite, BN, or stainless steel. According to the following reaction formula, 3 moles of $CaH_2$ reducing agent is required relative to 1 mole of $Dy_2O_3$. However, it is preferable to increase the reducing agent by 10% to 20% of the amount corresponding to 3 moles in order to completely reduce $Dy_2O_3$. The reduction reaction proceeds according to the following basic formula.

$$Dy_2O_3+3CaH_2 \rightarrow 2Dy+3CaO+3H_2$$

This heat-resistant vessel is set in an atmosphere furnace through which an Ar gas flows, and is kept at 800° C. to 1,100° C. for 10 minutes to 8 hours, followed by cooling. It is preferable that the oxygen concentration in the atmosphere is a few parts per million to a few tens of parts per million suitable for producing a Nd—Fe—B sintered magnet since oxidation of the magnet body can be suppressed. However, a vacuum exhaust gas system must be added to a reaction apparatus, and a long time is required to reach an extremely low oxygen concentration.

Therefore, the surface oxidation state of the magnet body and the magnetic properties were experimentally examined under various oxygen concentration conditions. As a result, there was no difference in apparent surface states up to an oxygen concentration of 1 percent by volume. Variations in the magnetic properties, e.g., the coercive force, in the case where the treatment was conducted in an atmosphere of an oxygen concentration of 1% were lowered about 2% as compared with those in the case where the treatment was conducted in an atmosphere of an oxygen concentration of 5 ppm. Therefore, there is no harm in conducting in an atmosphere of an oxygen concentration of 1 percent by volume or less. If the concentration exceeds 1 percent by volume, oxidation of the magnet surface during the treatment is increased and an extent of decrease in the coercive force is also increased.

Under the above-described conditions of atmosphere and temperature, the reaction can proceed in a solid phase while the magnet body and every compound powder are not melted. The temperature of less than 800° C. is not appropriate since it takes several tens to one hundred hours to complete the reaction represented by the formula described above. If the temperature exceeds 1,100° C., the crystal grain size of the magnet becomes coarse and the coercive force is reduced. Therefore, the reaction temperature must be specified at 800° C. to 1,100° C., and more preferably at 850° C. to 1,000° C.

The Dy metal produced by reduction through this reaction deposits on the magnet surface, and at the same time, the Dy metal diffuses and penetrates selectively into the crystal grain boundary phase in the inside of the magnet. A layer of Dy metal that has been unable to diffuse and stays on the surface is formed on the magnet surface.

After the reaction, the magnet body is taken out of the heat-resistant vessel, and is cleaned with pure water, followed by drying, so that a CaO powder on the magnet body surface is removed and a clean magnet surface covered with the layer of the Dy metal staying on the surface can be attained. Furthermore, uniform growth of the Nd-rich phase of grain boundaries is enhanced and, thereby, the coercive force can be further improved by adding an aging treatment at about 400° C. to 650° C. for about 30 minutes to 2 hours after the above-described reaction is completed. Since the temperature region of generation of the Nd-rich phase is 500° C. to 600° C., the effect is hardly exerted at less than 400° C. If the temperature exceeds 650° C., the Nd-rich phase grows excessively and, conversely, the coercive force is decreased. Therefore, when the aging treatment is added, it is better that the temperature range is specified to be 400° C. to 650° C.

As is described in the principle of the above-described grain boundary modification treatment, the thus produced magnet has a structure in which the Dy metal component has diffused and penetrated into the inside from the magnet surface and the crystal grain boundary phase has been enriched with the Dy element. This surface layer is a Dy-rich layer in which the Dy metal or Nd and Fe in the magnet are partially taken by a reaction and, therefore, the surface layer is more stable in the air as compared with $Nd_2Fe_{14}B$. Consequently, in the case of use at a few tens of degree centigrade and in a relatively low humidity environment, an anti-corrosive coating, e.g., nickel plating and resin coating, can be omitted.

<Second Method> Liquid Phase Reduction Method

For example, a mixture of a $DyF_3$ powder as an example of M metal compounds, a LiF powder, and Ca metal particles serving as a chemical reducing agent is put in a heat-resistant vessel, e.g., a graphite crucible, and a Nd—Fe—B base magnet body is embedded therein. This heat-resistant vessel is set in an atmosphere furnace similar to that in the above-described first method, and is kept at 850° C. to 1,100° C. for about 5 minutes to 1 hour, followed by cooling.

Under this condition, Ca metal is melted, and the reaction is allowed to proceed in a liquid phase while a melt is formed through the use of LiF to perform a function as a melting point depressant of a fluoride, an oxide, or a chloride of the M metal element. Borates, carbonates, nitrates, hydroxides, and the like of Ka and Na can be used as salts used for lowering the melting point similarly to LiF. In this manner, reduction is effected to produce the Dy metal as in the reaction in the first method, and deposition of the Dy metal by reduction on the magnet surface and diffusion into the inside of the magnet are effected simultaneously. A layer of Dy metal that has been unable to diffuse and stays on the surface is formed on the magnet surface.

In this case, a basic reduction reaction proceeds according to the following formula, and LiF is not directly involved in the reduction reaction of Dy.

$$2DyF_3+3Ca \rightarrow 2Dy+3CaF_2$$

After the reaction, the magnet body is taken out, and is cleaned with pure water while an ultrasonic wave is applied, followed by drying, so that $CaF_2$ is removed and a magnet surface covered with the layer of the Dy metal staying on the surface can be attained. In a manner similar to that in the first method, the thus produced magnet has a structure in which the Dy metal component has diffused and penetrated into the inside from the magnet surface and the crystal grain boundary phase has been enriched with the Dy element, as is described in the principle of the above-described grain boundary modification treatment.

<Third Method> Molten-Salt Electroreduction Method

For example, a $TbF_3$ powder, a LiF powder, and salts of metals, e.g., Ba, to lower the melting point to about 1,000° C. or less are put in a heat-resistant vessel, e.g., a crucible. A stainless steel basket is used as a cathode, and a magnet body is put therein. Graphite, an insoluble metal, e.g., Ti or Mo, an alloy rod, or the like is used as an anode. The cathode and the anode are embedded in a heat-resistant vessel, and the heat-resistant vessel is set in an atmosphere furnace through which an Ar gas flows. A melt is generated at 800° C. to 1,000° C., electrolysis is conducted at about 1 to 10 V and a current density of about 0.03 to 0.5 A/cm$^2$ for about 5 minutes to 1 hour and, thereafter, the electrolysis is stopped, followed by cooling.

The M metal may be used as a soluble anode in place of the insoluble metal/alloy serving as the anode. At that time, the M metal deposited by reduction on the magnet surface becomes a combination of a product from reduction of a raw material oxide or fluoride and an electrolytic deposit of a dissolved anode component.

The generation temperature of the melt is different depending on the type and the amount of the Li metal, the Ba metal, or salts thereof to be used. After the melting, the stainless steel net is promptly moved back and forth or rotated in such a way that reduction and diffusion of the Tb metal into the magnet body proceed uniformly. In the reduction reaction at this time, Tb ions reach the magnet body serving as the cathode during the electrolysis step and receive electrons at that sites so as to form the metal Tb. Consequently, the Tb metal is deposited by reduction on the magnet surface and diffuses into the inside of the magnet. A layer of Tb metal that has been unable to diffuse and stays on the surface is formed on the magnet surface.

After the reaction, the magnet body is taken out of the net basket, and is cleaned with pure water, followed by drying, so that a magnet body provided with the layer of the Tb metal staying on the surface can be attained. In a manner similar to those in the first and the second methods, the thus produced magnet has a structure in which the Tb metal component has diffused and penetrated into the inside from the magnet surface and the crystal grain boundary phase has been enriched with the Tb element, as is described in the principle of the above-described grain boundary modification treatment.

The amount of the M metal deposited by reduction on the magnet surface can easily be adjusted by changing the temperature and the treatment time in the above-described first to third methods. Since a high-temperature reduction reaction is used in the method of the present invention, a part of the M metal deposited by reduction on the magnet body surface diffuses and penetrates into the inside of the magnet at the instant following the deposition. Therefore, it is difficult to clearly determine the thickness of the M metal alone on the surface.

FIG. 1 is a model diagram of the crystal texture showing a cross section (a) of a known sintered magnet and a cross section (b) of a sintered magnet of the present invention. As shown in FIG. 1(*a*), the known sintered magnet has a structure in which a Nd-rich grain boundary phase surrounds $Nd_2Fe_{14}B$ grains, and when a small amount of Dy element is contained as well, the Dy element is allocated and present in both the $Nd_2Fe_{14}B$ crystal grains and the Nd-rich grain boundary phase. There is no difference in texture structures between the inside of the magnet and the surface. However, according to the cross section (b) of the sintered magnet of the present invention, the Dy element, which enters from the magnet surface by diffusion, enters a very small part of $Nd_2Fe_{14}B$ crystals in the surface layer, but does not enter most of $Nd_2Fe_{14}B$ crystals in the inside. On the other hand, the major portion thereof enters the Nd-rich grain boundary phase, and the texture structure is made to have a concentration gradient in which the concentration is high on the magnet surface side and the concentration, that is, the amount of presence, becomes low toward the inside.

FIG. 2 shows the distribution status of the Dy element, based on an EPMA image of a representative sample, Present invention (4). For the $Nd_2Fe_{14}B$ crystal grain, the M element penetrates only outermost one or two layers of the magnet, and a Dy metal layer present from the surface of the magnet body up to about 3 to 6 μm in depth toward the inside and a diffusion layer of Dy metal present from immediately below the Dy metal layer up to about 40 to 50 μm in depth are observed. As described above, in the reduction diffusion method of the present invention, the M element enters principal $Nd_2Fe_{14}B$ phase crystals in a few layers located at an outermost portion of the magnet, but substantially no additional M element is introduced in most of the principle phase crystals. Therefore, a decrease in the remanent magnetic flux density is suppressed, and an improvement of the coercive force is achieved since the M element selectively penetrates the crystal grain boundaries.

The coercive force of the magnet is influenced by a texture structure having a concentration gradient of the M element in the depth direction of the cross section of the magnet after a grain boundary modification treatment, as shown in FIG. 2, and a larger coercive force can be attained as the depth of the diffusion layer is increased. On the other hand, when the M element is allowed to diffuse and penetrate, the thickness (width) of the grain boundary phase is increased by about a few tens of percent. As the thickness of the grain boundary phase of this diffusion layer portion is increased and the depth of the diffusion layer is increased, larger amounts of M metal component is contained and, thereby, the remanent magnetic flux density is decreased. Therefore, in order to achieve a significant increase in the coercive force while a decrease in the remanent magnetic flux density is suppressed, it is important to appropriately control the amount of M element compound to be used and the reaction temperature and time in such a way that the M element does not become excessive.

In general, a proportion of the total M metal component, which is the sum of the component diffused into the magnet body and the component unable to diffuse and staying on the surface as the metal layer, must be 0.1 to 10 percent by mass relative to the total mass of the magnet in order to satisfy the above-described conditions, and 0.2 to 5 percent by mass is suitable for attaining high-performance magnetic properties.

In the case where a small amount, for example, about 1 percent by mass relative to the total mass of the magnet, of Dy is allowed to diffuse and penetrate for a short time, even when the coercive force is increased by a few tens of percent, a decrease in the remanent magnetic flux density is at a negligible level. Therefore, the maximum energy product (BH-max) becomes slightly larger than or equal to that before the treatment, and the squareness of the demagnetization curve is also slightly improved. When the Dy content is about 2 to 3 percent by mass, although the remanent magnetic flux density is slightly decreased, the squareness of the demagnetization curve is improved since Dy penetrates into the grain boundary phase adequately. As a result, the maximum energy product becomes slightly larger than or equal to that before the treatment, as in the above description.

Furthermore, another method for realizing effective improvement of the coercive force through the use of the M element can be adopted. In the method, relatively large amounts of M element is supplied to the magnet surface, a reduction diffusion treatment is conducted for a long time so as to allow the M element to penetrate into the deep part in the magnet in such a way that the proportion becomes about 2 to 4 percent by mass relative to the total mass of the magnet and, thereafter, a magnet surface layer having a decreased remanent magnetic flux density due to excess M element is removed. In the case where the surface is cut by about 0.05 mm or less after reduction and diffusion, the coercive force is hardly decreased by the cutting, and the remanent magnetic flux density is not changed by the cutting.

For example, a surface grinding method by using a surface or cylindrical grinder can be used as a method for removing the magnet surface layer. Alternatively, it is possible to remove the surface layer by dissolution with an acid. In that case, neutralization by an alkali or cleaning must be conducted adequately.

Thereafter, a method in which the magnet is further cut and, thereby, a plurality of magnets having predetermined shapes and sizes are produced can also be adopted. For the cutting, a disk-shaped cutting edge in which diamonds or GC (green corundum) abrasive grains are fixed on the perimeter portion of the cutting edge is used, a magnet piece is fixed, and the magnet is cut one by one, or a plurality of magnets may be produced simultaneously by cutting with a cutter (multi-saw) provided with a plurality of edges.

For example, in the case where a magnet having a thickness of 1 mm or less is subjected to the grain boundary modification treatment, desired magnetic properties can easily be attained by a short-time treatment through the use of a small amount of M element. However, for a magnet having a thickness of about 5 to 10 mm, it is necessary that the M element is allowed to penetrate into the depth of the magnet adequately, and the entire magnet is brought into a substantially homogeneous texture state. In a preferable method, cutting is conducted thereafter so as to decrease the number of press molding in the magnet production step.

EXAMPLE 1

The present invention will be described below in detail with reference to the examples.

Alloy flakes of about 0.2 mm in thickness were prepared by strip casting method from an ingot having a composition of $Nd_{12.5}Fe_{79.5}B_8$. The flakes were filled in a vessel, and were allowed to occlude hydrogen gas at 300 kPa, followed by being allowed to release the gas, so that a powder of indefinite shape having a size of 0.1 to 0.2 mm was produced. Subsequently, jet milling was conducted so as to produce a fine powder of about 3 μm. The resulting fine powder was filled in a mold, and was molded by application of a pressure of 100 MPa while a magnetic field of 800 kA/m was applied. The resulting material was put in a vacuum furnace and sintering was conducted at 1,080° C. for 1 hour. The resulting sintered material was cut to produce a plurality of tabular samples of 5 mm×5 mm×3 mm exhibiting anisotropy in the thickness direction, and one of the samples was taken as a sample of Comparative example (1) without being treated.

A mixture of 2 g of $Dy_2O_3$ powder and 0.7 g of $CaH_2$ powder was put in a stainless steel crucible, the above-described tabular sample was embedded, and the crucible was set in an atmosphere furnace through which an Ar gas flows. The maximum temperature in the crucible was set at 700° C., 800° C., 900° C., 1,000° C., 1,100° C., or 1,150° C. by controlling the furnace temperature, each retention time was set at 1 hour, and solid phase reduction and a diffusion and penetration treatment of Dy metal was conducted, followed by cooling.

The oxygen concentration in the atmosphere furnace from start to finish of the reaction was monitored and measured resulting in 0.05 to 0.2 percent by volume. Each sample was taken out of the crucible, a CaO powder on the magnet body surface was removed with a brush, and cleaning with pure water was conducted while an ultrasonic wave was applied. Alcohol was substituted for water, followed by drying. The resulting samples were numbered Present invention (1) to Present invention (6) in order of increasing heat treatment temperature, from 700° C. to 1,150° C.

The magnetic properties of each sample were measured by using a vibrating sample type magnetometer (VSM; Vibrating Sample Magnetometer) after pulse magnetization with 4.8 MA/m in a direction of the plate thickness of 3 mm was conducted. After the measurement, each sample was ground and subjected to ICP(Inductively Coupled Plasma) analysis to measure the amount of Dy contained in each sample. Table 1 shows the values of magnetic properties and the amount of Dy of each sample. When the amount of deposition is calculated as a film thickness on the assumption that the Dy metal is deposited as a film and does not diffuse, the sample of Present invention (1) corresponds to 0.3 μm, and the sample of Present invention (6) corresponds to 3.4 μm. FIG. 3 is a graph showing the coercive force and the remanent magnetic flux density of each sample, and FIG. 4 is a graph showing the amount of Dy of each sample.

TABLE 1

| Sample | Treatment temperature (° C.) | Hcj (MA/m) | Br (T) | (BH)max (kJ/m³) | Dy (percent by mass) |
|---|---|---|---|---|---|
| Comparative example (1) | — | 0.93 | 1.41 | 362 | 0 |
| Present invention (1) | 700 | 1.02 | 1.41 | 364 | 0.05 |
| Present invention (2) | 800 | 1.23 | 1.40 | 373 | 0.15 |
| Present invention (3) | 900 | 1.36 | 1.39 | 384 | 0.31 |
| Present invention (4) | 1000 | 1.44 | 1.40 | 375 | 0.37 |
| Present invention (5) | 1100 | 1.41 | 1.39 | 371 | 0.46 |
| Present invention (6) | 1150 | 1.27 | 1.34 | 351 | 0.57 |

As is clear from FIG. 3, for each sample of Present inventions (1) to (6), a decrease in the remanent magnetic flux density (Br) was hardly observed, and a significant increase in the coercive force (Hcj) was recognized as compared with those of the untreated sample of Comparative example (1). For the sample of Present invention (1), since the treatment temperature was 700° C., the reduction reaction of Dy did not proceed adequately, so that the amount of Dy taken into the magnet was less than 0.1 percent by mass. Consequently, an increase in the coercive force was a small level. However, further increase in the coercive force can be expected by increasing the treatment time to 1 hour or more.

For the sample of Present invention (6), as is clear from FIG. 2, the amount of Dy in the sample is increased. However, $Nd_2Fe_{14}B$ crystal grains are grown to become coarse, and both values of the remanent magnetic flux density and the coercive force tend to be slightly decreased. As is clear from FIG. 4, deposition of the Dy metal due to Ca reduction and the amount of diffusion into the magnet are increased as the treatment temperature is increased.

Furthermore, the coercive force equivalent to that of the sample of Present invention (4), which was treated at 1,000° C., was realized by using a usual Nd—Dy—Fe—B base sintered magnet, and the content of Dy at that time was plotted with a black circle in FIG. 4. As is clear from this, according to the method of the present invention, a desired coercive force can be achieved at about one-half the Dy content of the known sintered magnet. Therefore, there is an effect that a rare resource, Dy element, can be saved.

EXAMPLE 2

Slurry was prepared by adding a small amount of methanol to a mixture of 1 g of $Dy_2O_3$ powder and 0.3 g of $CaH_2$ powder, and the slurry was applied to each of the same tabular sample as that used in Example 1, followed by drying. On the other hand, slurry was similarly prepared from 1 g of $Dy_2O_3$ powder alone. The resulting slurry was similarly applied and dried. These were put in respective stainless steel crucibles, and the solid phase reduction and the diffusion and penetration were conducted by a heat treatment in an Ar gas atmosphere at 920° C. or 1,000° C. for 2 hours in each case.

A CaO powder on the surface of the magnet sample after the treatment was removed. Cleaning was conducted with pure water and alcohol, followed by drying. The former samples by using the mixed powder were taken as samples of Present inventions (7) and (8), and the latter samples by using the $Dy_2O_3$ powder alone was taken as samples of Comparative examples (2) and (3).

Table 2 shows the values of magnetic properties and the amount of Dy of each sample. The sample of Comparative example (1) described in Example 1 is shown again in Table 2. FIG. 5 shows the demagnetization curves of the samples of Comparative examples (1) to (3), and FIG. 6 shows the demagnetization curves of the sample of Comparative example (1) and the samples of Present inventions (7) and (8).

TABLE 2

| Sample | Treatment temperature (° C.) | Hcj (MA/m) | Br (T) | (BH)max (kJ/m$^3$) | Dy (percent by mass) |
|---|---|---|---|---|---|
| Comparative example(1) | — | 0.93 | 1.41 | 362 | 0 |
| Comparative example(2) | 920 | 1.05 | 1.40 | 334 | 0.02 |
| Comparative example(3) | 1000 | 1.48 | 1.39 | 298 | 0.29 |
| Present invention(7) | 920 | 1.36 | 1.39 | 365 | 0.27 |
| Present invention(8) | 1000 | 1.60 | 1.40 | 381 | 0.38 |

As is clear from Table 2, for the sample of Comparative example (2), in which the $Dy_2O_3$ powder was used alone and the heat treatment was conducted at 920° C., since the content of the Dy element was small, an increase in the coercive force was small while the maximum energy product ((BH)max) was decreased, as compared with those of the untreated sample of Comparative example (1). For the sample of Comparative example (3), in which the heating treatment was conducted at 1,000° C., the coercive force was significantly increased, whereas the maximum energy product was significantly decreased.

This is because a large height difference emerged in the demagnetization curve, as shown in FIG. 5. As a result of X-ray diffraction of the magnet sample surface, it was made clear that $NdFe_2$ and α-Fe phases were generated. That is, it is estimated that these phases were generated because $Dy_2O_3$ was reduced by reaction with the Nd—Fe—B magnet main body in the process of high-temperature heating and, as a result, the properties of the magnet main body were deteriorated significantly.

On the other hand, for the samples of Present inventions (7) and (8), in which the $CaH_2$ powder was used as the reducing agent, a significant increase in the coercive force and an improvement of the energy product were recognized as compared with those of the sample of Comparative example (1). Furthermore, as shown in FIG. 6, every demagnetization curve exhibits good squareness and a smooth curve is drawn. Therefore, in the case where the reducing agent was used, an improvement of magnetic properties, e.g., the coercive force, was able to be achieved without damaging the Nd—Fe—B magnet main body.

EXAMPLE 3

A mixture of 3 g of $DyF_3$ powder, 0.9 g of metal Ca particles, and 5 g of LiF powder was put in a graphite crucible, the tabular magnet sample used in Example 1 was embedded in the powder. Subsequently, the crucible was set in an Ar gas atmosphere furnace. The maximum temperature in the crucible was set at 900° C. by controlling the furnace temperature, and molten-liquid phase reduction reaction and a diffusion and penetration treatment were conducted for 5 to 60 minutes, followed by cooling.

Each sample was taken out of the crucible, reaction residues on the magnet body surface was removed with a brush, a CaO powder was removed by being dissolved in dilute sulfuric acid, and furthermore, cleaning with pure water and alcohol was conducted, followed by drying. The resulting samples were numbered Present invention (9) to Present invention (14) in order of increasing treatment time, from 5 to 60 minutes, and magnetic properties were measured as in Example 1. When the amount of deposition is calculated as a film thickness on the assumption that the Dy metal is deposited as a film and does not diffuse, the sample of Present invention (9) corresponds to 0.2 μm, and the sample of Present invention (14) corresponds to 3.0 μm.

As is clear from FIG. 7, for each sample of Present inventions (9) to (14), the remanent magnetic flux density was hardly decreased, and a significant increase in the coercive force was recognized as compared with those of the untreated sample of Comparative example (1). For the sample of Present invention (14), in which the heating treatment was conducted at 900° C. for 60 minutes, the coercive force substantially equivalent to that of the sample of Present invention (13), in which the heating treatment was conducted at the same temperature for 45 minutes, was exhibited. Therefore, it was made clear that the treatment time of 45 minutes was adequate for the deposition of Dy due to reduction and diffusion into the inside of the magnet in the present Example.

In addition, in order to make clear the influence of an increase in the coercive force exerted on the heat resistance of the magnet, the sample of Present invention (13) and the sample of Comparative example (1) were magnetized, and the surface magnetic fluxes thereof were measured. Thereafter, the samples were put in an oven at 120° C. The samples were taken out of the oven at respectively predetermined time, and were cooled to room temperature. Changes in demagnetizing factor were examined up to 1,000 hours. The demagnetizing factor was determined by dividing the amount of magnetic flux after keeping at 120° C. for a predetermined time by the initial amount of magnetic flux at room temperature. FIG. 8 shows the relationship between the demagnetizing factor and the elapsed time of each sample. The demagnetizing factor of the sample of Present invention (13) became about one-fifth that of the sample of Comparative example (1), and the change in demagnetizing factor was also small. Consequently, it was made clear that the demagnetization at high temperatures was able to be significantly improved.

EXAMPLE 4

Two magnet pieces having a size of 6 mm×6 mm×10 mm were cut from a Nd—Pr—Fe—B base sintered magnet, and one piece was taken as a sample of Comparative example (4) without being treated. The other piece was embedded in a mixture of 3 g of $DyF_3$ powder, 0.9 g of metal Ca particles, and 5 g of LiF powder, and molten-liquid phase reduction reaction and a diffusion and penetration treatment was conducted in an Ar atmosphere at 950° C. for 6 minutes, followed by cooling, as in Example 3.

The surface of this sample was cleaned and dried, and this was taken as a sample of Present invention (15). The magnetic properties were measured by using a vibrating sample type magnetometer. Subsequently, every surface of this sample was ground by 40 μm with a surface grinder. The sample from which the surface layer had been removed was taken as a sample of Present invention (16), and the magnetic measurement was conducted similarly. Finally, a central portion of 2 mm in thickness was cut from this sample of 10 mm in thickness so as to produce a magnet sample having a size of about 6 mm×6 mm×2 mm. This magnet sample was taken as a sample of Present invention (17), and the magnetic measurement was conducted.

TABLE 3

| Sample | Hcj (MA/m) | Br (T) | (BH) max ($kJ/m^3$) |
|---|---|---|---|
| Comparative example (4) | 1.36 | 1.38 | 343 |
| Present invention (15) | 2.21 | 1.32 | 312 |
| Present invention (16) | 2.19 | 1.36 | 361 |
| Present invention (17) | 2.15 | 1.37 | 356 |

As is clear from Table 3, for the sample of Present invention (15) in the state as was subjected to the molten-liquid phase reduction treatment, the coercive force was significantly increased as compared with that of the sample of Comparative example (4). However, the remanent magnetic flux density and the maximum energy product were slightly decreased as compared with those before the treatment. This is because the Dy component was allowed to penetrate into the deep portion of the sample due to the high-temperature long-duration treatment, whereas the Dy component became slightly excessive on the surface portion.

On the other hand, for both the sample of Present invention (16), in which the surface layer was removed, and the sample of Present invention (17), which was the central portion cut from the sample, the coercive forces were hardly decreased, the remanent magnetic flux densities were subsequently equal to the values before the treatment, and the maximum energy products were further increased as compared with those before the treatment. Therefore, it is possible to produce a magnet having desired magnetic properties by appropriately selecting conditions, for example, the magnet is allowed to be in the state as is subjected to the reduction and diffusion treatment or is subjected to processing, e.g., cutting, after the treatment, depending on the size of the magnet sample.

EXAMPLE 5

As in Example 1, a plurality of tabular samples of 6 mm×30 mm×2 mm exhibiting anisotropy in the thickness direction were produced from an ingot having a composition of $Nd_{10.5}Dy_2Fe_{78.5}Co_1B_8$ through grinding, molding, sintering, and cutting steps. One of the samples was taken as a sample of Comparative example (5) without being treated. A mixture of 3 g of $TbF_3$ powder, 3 g of LiF powder, and 2 g of $Na_2B_4O_7$ powder was put in a BN crucible. A cathode was prepared by putting the tabular sample in a stainless steel net basket, a Mo metal was used as an anode, and these were embedded in the crucible. Subsequently, the crucible was set in an Ar gas atmosphere furnace, and the maximum temperature in the crucible was set at 920° C. by controlling the furnace temperature. The cathode and the anode were connected to an external power supply. Molten-salt electrolysis was conducted at an electrolytic voltage of 5 V and a current density of 80 $mA/cm^2$ for 5, 10, 20, or 30 minutes. Thereafter, the electrolysis was stopped, followed by cooling.

The magnet body was taken out of the net basket, and cleaning with pure water was conducted, followed by drying. Pure water cleaning was conducted while an ultrasonic wave was applied, and alcohol was substituted for water, followed by drying. The resulting samples were numbered Present invention (18) to Present invention (21) in order of increasing treatment time, 5, 10, 20, and 30 minutes. When the amount of deposition is calculated as a film thickness on the assumption that the Dy metal is deposited as a film and does not diffuse, the sample of Present invention (18) corresponds to 1.2 μm, and the sample of Present invention (20) corresponds to 6 μm.

Table 4 shows the values of magnetic properties and the amount of Tb of each sample. As a result of analysis, it was made clear that 0.3 percent by mass or less of fluorine was taken in each sample produced by the molten-salt electroreduction method. As is clear from Table 4, the coercive force was significantly increased as the treatment time was increased, whereas a decrease in the remanent magnetic flux density was relatively small.

TABLE 4

| Sample | Treatment time (min.) | Hcj (MA/m) | Br (T) | Tb (percent by mass) |
|---|---|---|---|---|
| Comparative example (5) | — | 1.52 | 1.36 | 0 |
| Present invention (18) | 5 | 1.81 | 1.35 | 0.17 |
| Present invention (19) | 10 | 2.02 | 1.34 | 0.29 |
| Present invention (20) | 20 | 2.24 | 1.32 | 0.63 |
| Present invention (21) | 30 | 2.41 | 1.30 | 0.94 |

INDUSTRIAL APPLICABILITY

According to the method for modifying grain boundaries of the Nd—Fe—B base sintered magnet of the present invention, it becomes possible to significantly increase the coercive force by the texture structure in which Dy and Tb metal components are hardly taken in the principal phase and selectively present in the grain boundary phase. Furthermore, the amount of Dy and Tb components, which are previously taken in the principal $Nd_2Fe_{14}B$ phase in a magnet alloy and are responsible for a decrease in the remanent magnetic flux density, can be significantly reduced to about one-half to one-third the original amount. Consequently, there are effects of saving rare resources and reducing the magnet cost.

Figure 1:
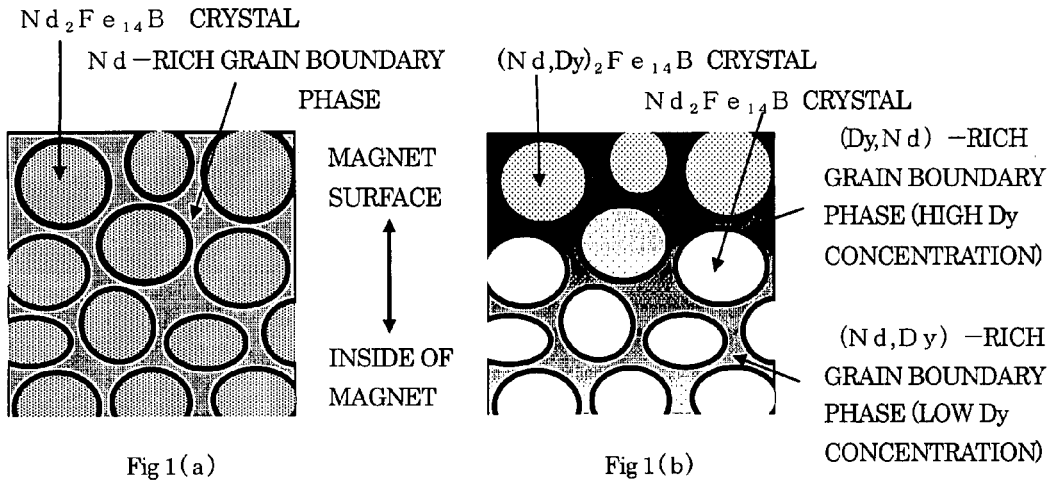
FIG. 1 is a model diagram of the crystal texture showing a cross section (a) of a known sintered magnet and a cross section (b) of a sintered magnet of the present invention.
Figure 2:
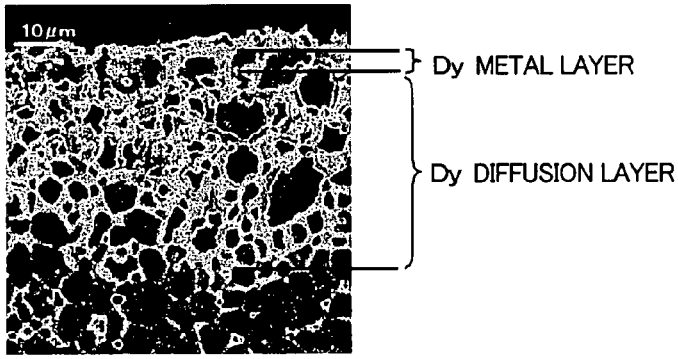
FIG. 2 shows the distribution status of the Dy element based on an EPMA image of the sample of Present invention (4).
Figure 3:
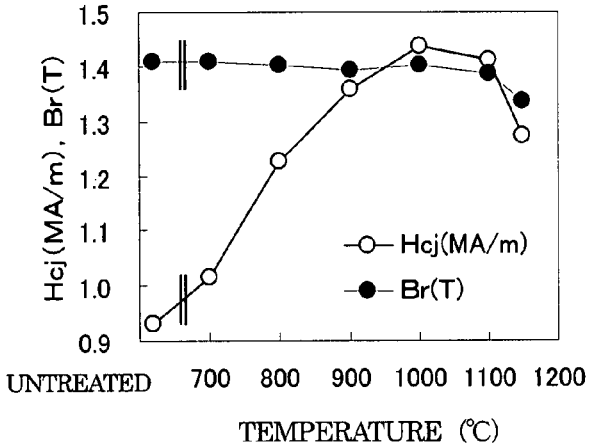
FIG. 3 is a diagram showing the relationship of the heating temperature in the reduction and diffusion treatment relative to the remanent magnetic flux density and the coercive force for the samples of Present inventions (1) to (6) and Comparative example (1).
Figure 4:
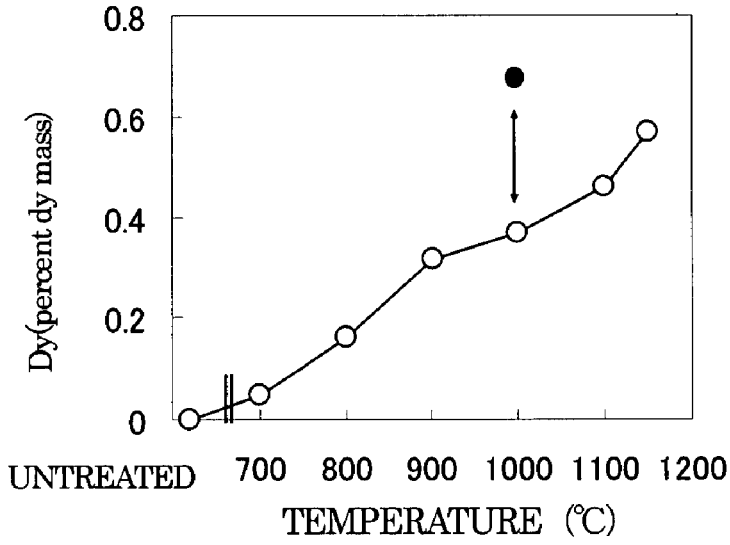
FIG. 4 is a diagram showing the relationship of the heating temperature in the reduction and diffusion treatment relative to the Dy content for the samples of Present inventions (1) to (6) and Comparative example (1).
Figure 5:
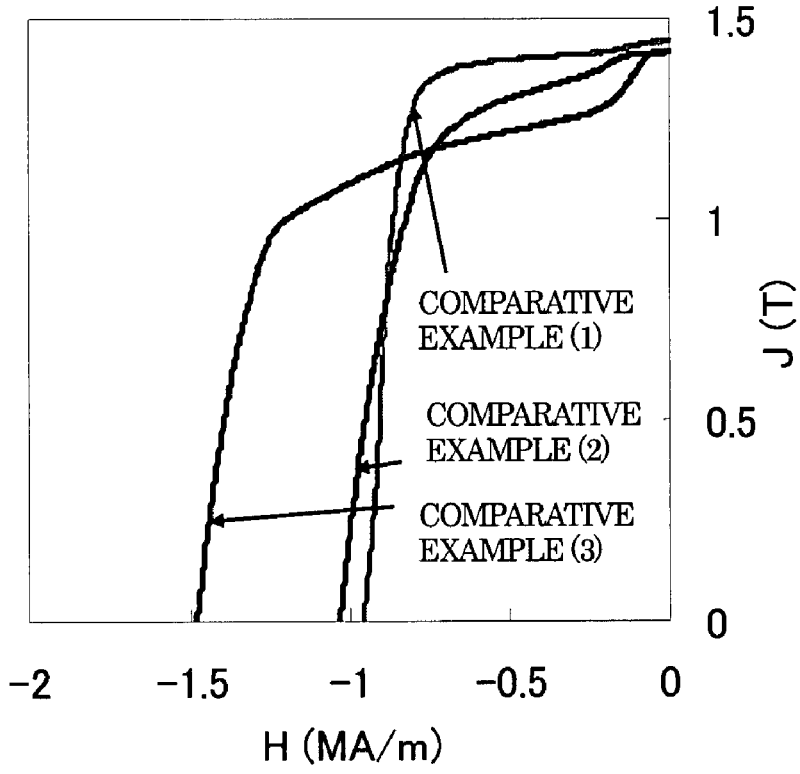
FIG. 5 is a diagram showing the demagnetization curves of the samples of Comparative example (1) to (3).
Figure 6:
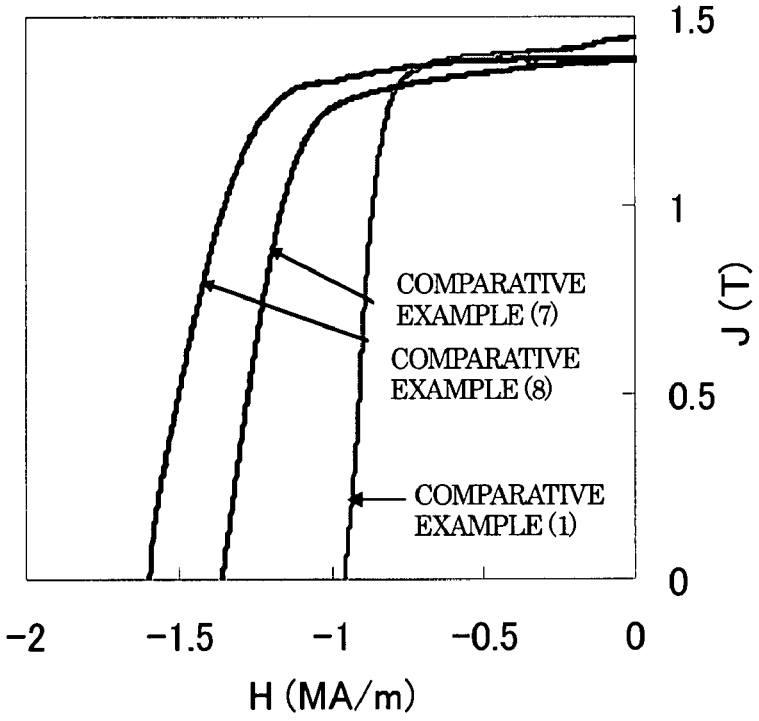
FIG. 6 is a diagram showing the demagnetization curves of the samples of Present inventions (7) and (8) and Comparative example (1).
Figure 7:
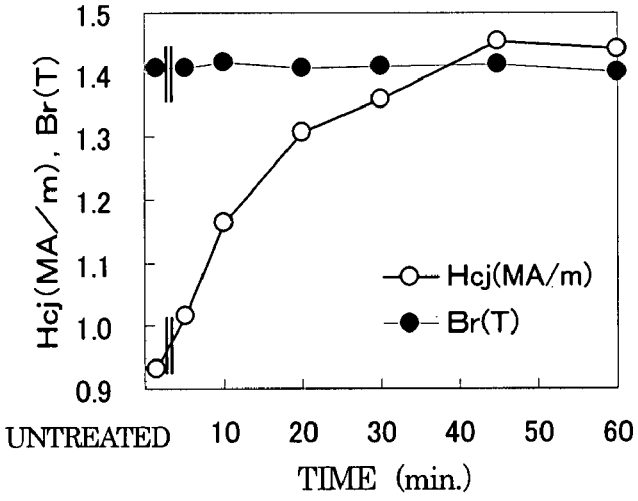
FIG. 7 is a diagram showing the relationship of the heating time in the reduction and diffusion treatment relative to the remanent magnetic flux density and the coercive force for the samples of Present inventions (9) to (14) and Comparative example (2).
Figure 8:
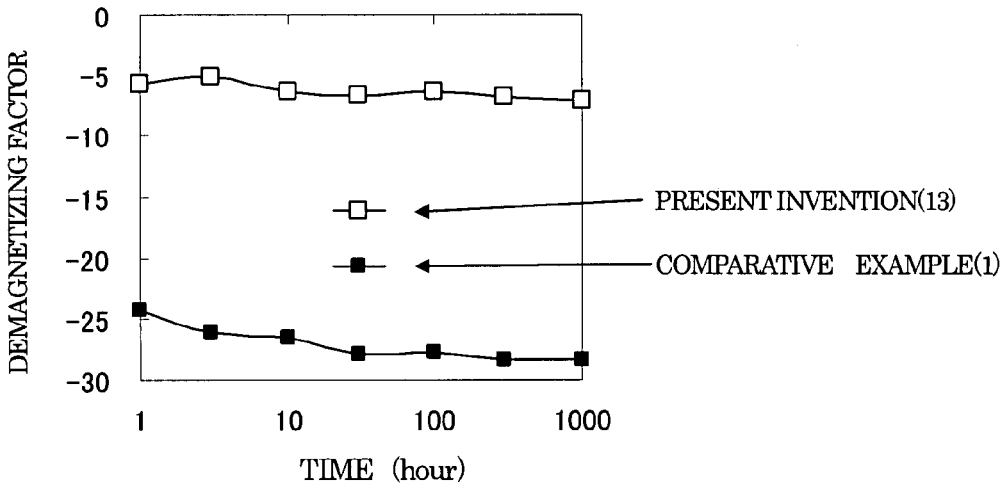
FIG. 8 is a diagram showing the relationship between the demagnetizing factor and the elapsed time of the samples of Present invention (13) and Comparative example (1), where the demagnetizing factor was determined by dividing the amount of magnetic flux after keeping at 120° C. for a predetermined time by the initial amount of magnetic flux at room temperature.

The invention claimed is:

1. A method for modifying grain boundaries of a Nd—Fe—B base magnet comprising:

placing a Nd—Fe—B base sintered magnet body in contact with a compound selected from a fluoride, an oxide, or a chloride of an M metal element (where M is Pr, Dy, Tb, or Ho);

reducing the compound of M metal element by using a chemical reducing agent selected from the group consisting of Ca metal, Mg metal or a hydride thereof such that M metal element deposits on the Nd—Fe—B base sintered magnet body; and keeping the Nd—Fe—B base sintered magnet body at a temperature in a range of 800° C. to 1100° C., wherein the M metal element to diffuse and penetrate from a surface of the Nd—Fe—B base sintered magnet body having a Nd-rich crystal grain boundary phase surrounding principal $Nd_2Fe_{14}B$ crystals to the grain boundary phase.

2. The method for modifying grain boundaries of a Nd—Fe—B base magnet according to claim 1, wherein the Ca metal or the Mg metal is used as the chemical reducing agent, a melting point lowering agent of the fluoride, the oxide, or the chloride of the M metal element is added, and the reducing step is conducted in a liquid phase.

3. A method for modifying grain boundaries of a Nd—Fe—B base magnet, comprising:

heat-melting a compound selected from a fluoride, an oxide, or a chloride of an M metal element (where M is Pr, Dy, Tb; or Ho) and a Li metal, a Ba metal, or a salt thereof;

reducing the compound through molten-salt electrolysis using the Nd—Fe—B base sintered magnet body as a cathode, and a metal, an alloy, or graphite as an insoluble anode, wherein the M metal element to diffuse and penetrate from a surface of the Nd—Fe—B base sintered magnet body having a Nd-rich crystal grain boundary phase surrounding principal $Nd_2Fe_{14}B$ crystals to the grain boundary phase.

4. The method for modifying grain boundaries of a Nd—Fe—B base magnet according to claim 3, wherein a metal/alloy of the M metal element is used as a soluble anode in place of the insoluble anode.

5. The method for modifying grain boundaries of a Nd—Fe—B base magnet according to claim 1, wherein the reducing step is conducted in a low-oxygen atmosphere having an oxygen concentration of 1 percent by volume or less.

6. The method for modifying grain boundaries of a Nd—Fe—B base according to claim 1, wherein an aging treatment is conducted following the reducing step.

* * * * *